US005845187A

United States Patent [19]

Eggerstorfer et al.

[11] Patent Number: 5,845,187

[45] Date of Patent: Dec. 1, 1998

[54] TURN-OVER MEANS FOR BAND-SHAPED RECORDING MEDIA

[75] Inventors: Vilmar Eggerstorfer, Poing; Otto Ferber, Germering, both of Germany

[73] Assignee: Oce Printing Systems GmbH, Poing, Germany

[21] Appl. No.: 817,181

[22] PCT Filed: Oct. 4, 1995

[86] PCT No.: PCT/DE95/01358

§ 371 Date: Apr. 7, 1997

§ 102(e) Date: Apr. 7, 1997

[87] PCT Pub. No.: WO96/11159

PCT Pub. Date: Apr. 18, 1996

[30] Foreign Application Priority Data

Oct. 6, 1994 [DE] Germany ..... 44 35 756.7

[51] Int. Cl.[6] ..... G03G 15/00

[52] U.S. Cl. ..... 399/384

[58] Field of Search ..... 399/384, 388, 399/397, 400, 401, 364; 242/615, 615.12, 615.21; 271/184–186; 226/108

[56] References Cited

U.S. PATENT DOCUMENTS

| | | | |
|---|---|---|---|
| 4,154,386 | 5/1979 | Kawada | 226/91 |
| 4,610,198 | 9/1986 | Raymond | 242/615.21 |
| 5,467,179 | 11/1995 | Boeck et al. | 399/384 |
| 5,546,178 | 8/1996 | Manzer et al. | 399/384 |
| 5,568,245 | 10/1996 | Ferber et al. | 399/384 |

FOREIGN PATENT DOCUMENTS

| | | |
|---|---|---|
| A 43 35 473 | 4/1995 | Germany . |
| A 6 609 932 | 1/1968 | Netherlands . |
| WO A 92 15513 | 9/1992 | WIPO . |
| WO A 94 27193 | 11/1994 | WIPO . |

OTHER PUBLICATIONS

IBM Technical Disclosure Bulletin, vol. 22, No. 6, Nov. 1979, New York, U.S. K. Sanders, "Tow–Path Electrophotographic Print Process".

*Primary Examiner*—William J. Royer
*Attorney, Agent, or Firm*—Hill & Simpson

[57] ABSTRACT

A turn-over apparatus for a printer for printing on both sides of a web-shaped recording medium has two acutely angled deflectors to turn the recording medium over. The angles of the deflectors are such that the converging ends of the deflectors are spaced apart. Automatic threading of the recording medium is provided.

16 Claims, 11 Drawing Sheets

TURN-OVER MEANS FOR BAND-SHAPED RECORDING MEDIA

BACKGROUND OF THE INVENTION

1. Field of the Invention

The present invention is directed to a turn-over means for band-shaped recording media arranged within an electrographic printer device.

2. Description of the Related Art

A high economic customer benefit and a broad spectrum of flexibility are expected to a greatly increasing degree from modern electrographic printer systems. The effective utilization of printing materials as well as the flexible design of the print information play a great part therein.

Endlessly processing (fan-fold) electrographic printer systems that print a band-shaped recording medium on one side have prevailed in the marketplace everywhere that a high device availability given high printing volume and a broad spectrum of printing materials are required. These printer systems, however, have the disadvantage that it is not possible to switch between single-sided and double-sided printing. For the user, this leads both to an economically unfavorable situation as well as to a contradiction of the contemporary demands for efficient utilization of raw materials. Many customer-specific applications that necessarily require double-sided printing (brochures, books, etc.) can thus not be satisfied, particularly since electrographic high-performance printers are especially economical when they are operated interruption-free insofar as possible.

For generating multi-color and backside printing with electrographic printer devices working with continuous stock, European Patent Document EP-B1-01 54 695 has disclosed that two continuous stock printers be operated following one another, whereby the paper printed in the first printer is turned over and is subsequently printed on the second side in the second printer.

The outlay is substantial because of the required second printer.

The publication IBM Technical Disclosure Bulletin, Vol. 22, No. 6, November 1979, pages 2465–2466, also discloses an electrophotographic printer means for printing band-shaped recording media with which it is possible to print the recording medium on both sides. To this end, the recording medium is taken from a supply stack, supplied to a transfer printing station, and provided with toner images on one side. After the fixing step, the recording medium is turned over with the assistance of a turn-over means composed of deflection rods and is resupplied to the transfer printing station. After the back side of the recording medium is printed with toner images, another fixing ensues in the fixing station.

The printer device contains a turn-over means for band-shaped recording media with a paper admission channel and a paper outlet channel that are successively arranged in one plane, whereby the recording medium, proceeding from the paper admission channel, is guided via deflection elements up to the paper outlet channel such that the recording medium folds completely over around the boundary line between the channels.

This old reference basically describes duplex printing with continuous stock recording media. However, the proposal never lead to a product. Further, the described electrographic printer means is only suitable for the both-sided printing of the recording medium. A change in operating mode is not provided. The turn-over means composed of deflection rods, that is employed, requires a manual threading of the recording medium; further, the way in which the deflection rods are arranged requires much installation space.

In such electrographic printer devices for printing band-shaped recording media in duplex printing, the recording medium is successively conducted through the units of the printer device via two conveying paths lying side-by-side. The turn-over station thereby has the job, first, of turning the recording medium over by 180° in terms of page position; second, it must steer the recording medium from the one into the other conveying path. In order to keep the width of the units as small as possible and in order to use this as efficiently as possible, it is necessary to guide the recording medium webs side-by-side in as close a spacing as possible. Particularly in view of the turn-over station, there is thus the problem of turning the recording medium over and displacing it in the tightest space.

SUMMARY OF THE INVENTION

It is therefore a goal of the invention to offer a compact, user-friendly turn-over means of for a band-shaped recording medium wherein the entering and the departing recording medium is guided next to one another in the closest possible spacing.

A further goal of the invention is to fashion the turn-over means such that it enables an automatic threading of the recording medium.

In an electrographic printer device with a one-sided and both-sided printing of a band-shaped recording medium is possible, the turn-over means should also be capable of being arranged integrated therein in user-friendly fashion.

These goals of the invention are achieved by a turn-over means for band-shaped recording media which has

- a paper admission channel and a paper discharge channel that are arranged next to one another in close proximity,
- a first turning triangle allocated to the paper admission channel and a second turning triangle allocated to the paper discharge channel, each respectively comprising a straight deflection element and an oblique deflection element arranged at an angle of about 45° thereto, whereby
  - a) the recording medium, proceeding from the paper admission channel, is guided via the deflection elements of the turning triangles up to the paper discharge channel such that the recording medium folds completely over around the boundary line between the channels, and
  - b) the turning triangles are arranged in a plane parallel to the paper admission channel and paper discharge channel turned relative to one another by a prescribable spread angle such that the recording medium is spread in the region between the ends of the oblique deflection elements tapering toward one another, whereby the spread angle exhibits a minimum value with reference to the deflection radius of the deflection elements employed that the band edges of the entering and exiting recording medium that are directed toward the middle can be guided adjoining one another in close proximity in the region of the boundary line between the channels.

As an improvement, the turn-over means has a spread angle of 10 through 20 angular degrees. Preferrably, a threading means for the recording medium is included that comprises a motor-driven gripper element with gripper means for the recording medium, whereby, for threading into the turn-over means, the start of the recording medium is grasped in the region of the first turning triangle and is conveyed via the second turning triangle through a guide channel embracing the turning triangles into the region of the paper discharge channel.

In one embodiment, a gripper element is provided as a friction element. A conveyor belt is included that is arranged in the region within the deflection elements of the turning triangles and accepts the friction element, the conveyor belt being guided such that the friction element dips into the guide channel in sections between the deflection elements and thus enters into frictional contact with the recording medium. The friction element can be positioned via the conveyor belt into an idle position in which it is disengaged from the recording medium. The conveyor belt comprises elastic conveying lamellae.

Transport rollers are provided for the recording medium arranged in the guide channel. The deflection elements comprise air exit openings at least in their deflection region that can be coupled to an air supply system and that serve for generating a friction-reducing air pillow. The deflection elements are fashioned as hollow members that are in communication with one another for a common air supply.

In one example, the turn-over means comprises paper transport elements that are arranged in the paper admission channel and/or in the paper discharge channel and that deliver the start of the recording medium to the first turning triangle or accept it from the second turning triangle.

The turn-over means has a first sensor acquiring the position of the gripper element, a second sensor sensing the recording medium in the region of the first turning triangle, and a threading control arrangement coupled to the sensors and recording medium conveyor means that, for threading the start of the recording medium, acquires the start of the recording medium in the region of the first turning triangle via the second sensor, activates the threading means dependent thereon, and, after threading the start of the recording medium through into the paper discharge channel, positions the gripper element in an idle position in which it is disengaged from the recording medium.

The preferred turn-over means is fashioned as an independent structural unit and is interchangeably secured in the device via fastening means. A displacement means serves as a fastening means.

The turn-over means of the invention is for use in an electrographic printer device for printing band-shaped recording media, comprising an intermediate carrier with appertaining units for generating toner images on the intermediate carrier;

a transfer printing station that is allocated to the intermediate carrier and accepts the recording medium;

a fixing station following the transfer printing station in conveying direction for fixing the toner images on the recording medium, whereby intermediate carrier, transfer printing station and fixing station comprise a usable width of at least twice the band width of the recording medium, and the turn-over means follows the fixing station and can be coupled to the transfer printing station via the paper discharge channel.

The printer has the paper admission channel of the turn-over means in communication, couplable via paper transport elements, with a recording medium output channel allocated to the fixing station that comprises a usable width of at least twice the band width of the recording medium.

The inventive turn-over station comprises a paper entry channel and a paper discharge channel that are arranged closely spaced side-by-side in one plane. In a second plane parallel thereto, each channel contains an acute-angled deflection in the form of a turning triangle having a straight deflection element and an oblique deflection element arranged at an angle of approximately 45° relative thereto. They are turned relative to one another by a spread angle of about 10° to 20°, so that the recording medium is spread in the region between the ends of the oblique deflection elements that approach one another.

As a result of this geometry, the entering and the departing recording medium can be theoretically guided next to one another with a spacing of zero, and the required width of the turn-over station becomes minimal. Further, the turn-over station requires comparatively little length for the turn-over function. A compact structure with a low tendency toward transverse vibrations of the recording medium thus derives. It is therefore especially suited for installation in a multifunctional printer device for the single-sided or both-sided printing of a band-shaped recording medium.

The turn-over station enables a manual insertion of the recording medium in a simple way. However, it can also comprise an automatic threading means having an inwardly disposed, motor-driven conveyor belt with a friction element arranged thereon. When an automatic conveying is not possible because of critical properties of the recording medium, the outer wall can be removed with a few manipulations and the recording medium can be manually inserted. An air-guidance system by the deflection elements generates a friction-reducing air pillow at the deflection points, this reduces the risk of tearing.

BRIEF DESCRIPTION OF THE DRAWINGS

Embodiments of the invention are shown in the drawings and are described in greater detail below by way of example. Shown are.

DETAILED DESCRIPTION OF THE PREFERRED EMBODIMENTS

Figures 1, 1A:
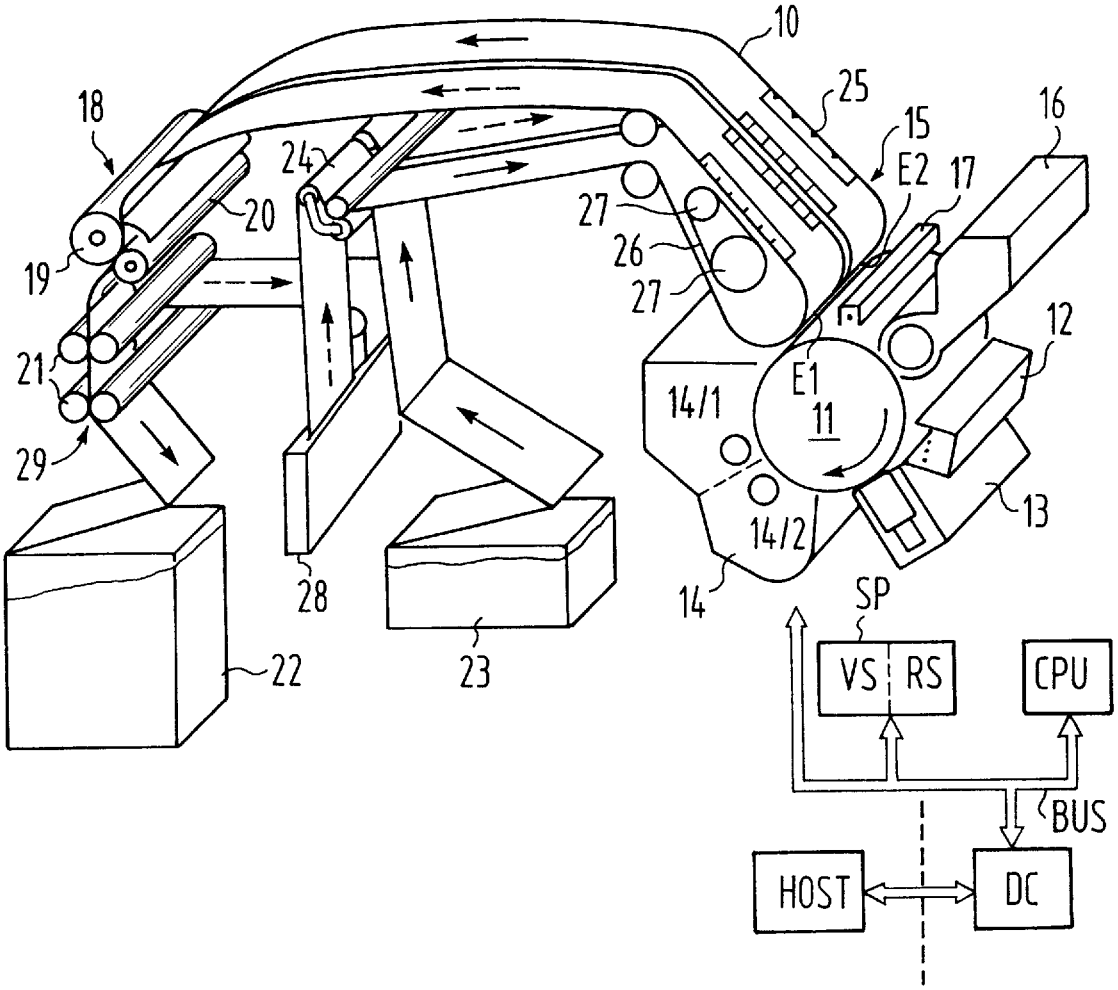
FIG. 1 is a schematic illustration in perspective of an electrographic printer means for printing band-shaped recording media in a simplex or duplex operation.
FIG 1*a* is a block circuit diagram of a control circuit for the printer of FIG. 1.

An electrographic printer means for printing band-shaped recording media or medium 10 of different band widths contains an electromotively driven photoconductive drum as an intermediate carrier 11. However, a band-shaped intermediate carrier, for example an OPC band, or a magneto-styli arrangement as disclosed, for example, by European Patent Document EP-B1-0 191 521 can also be employed instead of the photoconductive drum. The various units for the electrophotographic process are grouped around the intermediate carrier 11. These are essentially: a charge means 12 in the form of a charge corotron for charging the intermediate carrier 11; a character generator 13 with a light-emitting diode comb for character-dependent exposure of the intermediate carrier 11 that extends over the entire usable width of the intermediate carrier 11; a developer station 14 for inking the character-dependent charge image on the intermediate carrier 11 with the assistance of a one-component or two-component developer mix; a transfer printing station 15 that extends over the width of the intermediate carrier 11 and with which the toner images are transferred onto the recording medium 10. A cleaning station 16 with cleaning brushes and an appertaining extraction means integrated therein as well as a discharge means 17 is provided for removing the residual toner after the development and the transfer printing. The intermediate carrier 11 is electromotively driven and moves in an arrow direction during the printing operation.

Further, the printer means contains a fixing station 18 that follows the transfer printing station 15 in the conveying direction of the recording medium, this fixing station 18 being fashioned as a thermal pressure fixing station with a heated fixing drum 19 with an appertaining pressure roller 20, and also contains guide rollers following the fixing station that, among other things, serve as output elements for a stacker means 22 for the recording medium. Other fixing stations, for example with a heated or unheated admission saddle or a cold fixing station are also possible instead of the illustrated fixing station. The band-shaped recording medium 10 is fabricated, for example, as pre-folded continuous stock with margin perforations and, proceeding from a supply region 23, is supplied via delivery rollers 24 to the transfer printing station 15. However, it is also possible to supply a recording medium without margin perforations via a roller delivery.

Transporting of the recording medium thereby preferably ensues via a conveyor means 25 allocated to the transfer printing station 15 in the form of conveyor or tractor belts 26 provided with pins that, conducted over drive wheels 27, engage into the margin perforations of the recording medium 10. When a recording medium that is free of transport holes is employed, an appropriately adapted conveyor means which is familiar to a person skilled in the art is to be provided that transports the recording medium by, for example, friction under the control of a control arrangement that senses synchronization marks. Further, a turn-over means 28 is arranged in the housing region of the printer means supply region and fixing station 18; the structure and function of this means 28 shall be explained later, the recording medium being returned from the fixing station to the transfer printing station 15 thereover.

The printer means is controlled via a printer controller, which is schematically shown in FIG. 1*a,* comprising a central unit CPU, a page memory SP that is divided page-dependent into memory areas, as well as a data control unit DC. All units of the controller are connected via a BUS system to one another and to the units of the printer means.

The electrographic printer means is suitable for printing recording media with different band widths. To this end, the intermediate carrier 11 (photoconductive drum) exhibits a usable width that corresponds to the biggest possible recording medium width (for example, a DIN A3 crosswise). This width corresponds to twice the DIN A4 band width. It is thus possible to arrange two recording medium widths format DIN A4 longitudinally side-by-side in the region of the transfer printing station 15. The fixing station 18 and the other electrophotographic units such as developer station 14, character generator 13, cleaning station 16 are designed according to this usable width.

An adaptation of the width of the character generator 13 to different recording medium widths requires no mechanical alteration at the character generator when, as in this case, a LED character generator having a plurality of LEDs arranged in rows is employed. An adaptation to the recording medium width employed ensues electronically by control.

For adaptation of the conveyor means 25 to different recording medium widths, the conveyor means can be designed to be adjustable in width. This can be achieved, for example, in that the drive wheels that carry the conveyor belts (nap belts or knob belts) engaging into the margin perforations of the recording medium are displaceably seated on polygonal shafts.

When two narrow recording medium webs are arranged side-by-side in the region of the transfer printing stationl5 and transported, then it normally suffices to provide a conveyor means only for the respectively outwardly disposed margin perforations of the recording medium webs. Given an appropriate design, it is therefore possible to employ the same conveyor belts for the broad recording medium and the narrower recording medium or media without having to adjust these conveyor belts. If it is nonetheless necessary to guide the recording media at both sides, then separate transport elements that engage into the margin perforations of the recording media can be centrally arranged for operation with two narrow recording media arranged next to one another. So that these transport element do not interfere given operation with only one broad recording medium, they can be arranged to be pluggable and unplug gable or pivotable or, on the other hand, it is possible to provide the drive wheels 27 of the conveyor means 25 with pins or, respectively, nubs that can be extended and retracted.

The turn-over means 28 arranged in a return channel for narrow recording media from the fixing station 18 to the transfer printing station 15 serves for front side/back side flipping of the recording medium. It can be designed to be switchable dependent on operating mode and comprises an automatic threading means for the recording medium.

For both-sided printing of a narrow recording medium in the duplex operation as shown in FIG. 1, the narrow recording medium 10, for example DIN A4 wide, is supplied to the transfer printing zone E2 of the transfer printing station 15 via the delivery rollers 24 proceeding from the supply region 23 and is printed with a front side toner image on its upper side. The front side of the recording medium 10 is thereby identified by solid-line transport arrows, the underside by broken-line transport arrows. The recording medium with the front side toner image is then supplied to the fixing station 18, and the front side toner image is fixed to the recording medium. Continued transport of the recording medium then ensues via the guide rollers 21 to the turn-over means 28 whose deflection contour is positioned in a turn-over attitude. The recording medium is flipped with respect to its front and back side in the turn-over means 28 and is resupplied to the transfer printing means 15 in the region of the transfer printing zone E1 via the de liver rollers 24 such that its back side can be provided with a back side toner image. Subsequently, the recording medium is resupplied to the fixing station 18 and the back side toner image is fixed, and, subsequently, the recording medium which has been printed on both sides is deposited in the stacker means.

Since the front side and back side toner images are generated and are transfer printed onto the single, narrow recording medium at different points in time, a corresponding data editing via the printer controller is needed. To this end, the page memory SP contains memory areas VS for storing the front side (verso) image data and memory areas RS for storing the back side (recto) image data. The data editing thereby ensues via the data control means DC, whereby the data are supplied to the data control means DC from a data source (HOST), for example an external data storage, via an interface. The data of the individual pages to be printed are thereby deposited in the page memory SP, namely in the appropriate memory areas separated according to front side VS and back side RS. The calling of the data then ensues under time control, so that the desired front side/back side allocation of the toner images on the recording medium is achieved.

Turn-Over Means

The turn-over principle on which the invention is based is first discussed in terms of basics with reference to FIGS. 3 through 6. The letter R in the FIGS. thereby indicates the printed side of the recording medium 10, namely drawn broken facing away from the observer and solid facing toward the observer.

Figure 3:
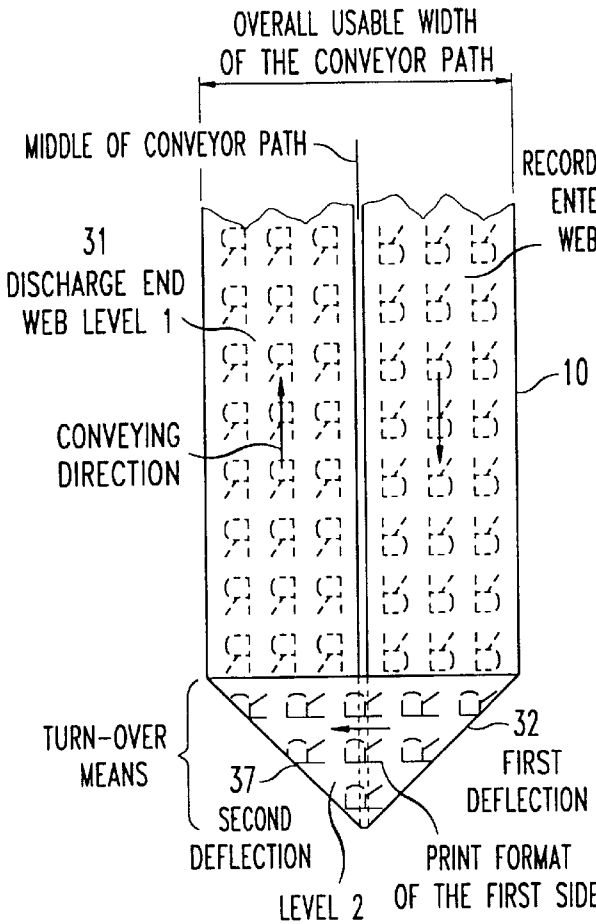

As shown in FIG. 3, a band-shaped recording medium 10 whose width maximally occupies half of an available conveying path can be guided onto the second half with only two 90° deflections, whereby the band side is simultaneously reversed. To this end, the recording medium 10 supplied via a paper admission channel is conducted over two first and second oblique deflection elements 32, 37 which is arranged at an angle of 45° up to a paper discharge channel 31. The recording medium moves between the two 45° deflections in a different plane than before or, respectively, after. After this turning event, that band edge directed into the middle of the conveying path before the reverser likewise points inward. Proceeding from the paper admission channel 30, the recording medium is thus guided such via the deflection elements to the paper discharge channel 31 that the recording medium folds completely over around the boundary line between the channels. Of course, recording media having a smaller width than half the conveying path width can also be turned in this way. To that end, the position of the entering recording medium can be arbitrarily positioned in the region of half its conveying path width. It is usually meaningful to select a defined position that is preferably oriented with respect to the operating conditions given full path width. Thus, this will either be one of the two outer conveying path limitations or the exact middle of the conveying path. Given operation of the reverser and the path middle as a fixed reference, the position of the side edges varies symmetrically relative to the middle given different widths of the recording media. Given operation of the reverser and a path edge as a fixed reference, the position of the side edge that is directed toward the middle varies given different widths of the recording media. In both cases, the position of the reverser is independent of the width of the recording medium and can thus be rigidly installed in the system. This is different given turning devices for band-shaped recording media that are wider than half the available conveying path. Here, the position of the reverser must be modified in certain instances with the width of the recording medium being utilized.

When the recording medium 10 occupies the entire half of the conveying path, i.e. when paper admission channel 30 and paper discharge channel 31 are directly adjacent to one another, the band edges directed toward the middle given the arrangement of the deflection elements according to FIG. 3 meet in a point at the tip of the turn-over means. Moreover, the required radius of the deflection elements would be equal to zero. In the real operation, however, a deflection is only possible with finite radii. The two inwardly directed side edges move all the farther away from one another the more the dimensions of the deflections elements deviate from zero, i.e., with the arrangement of the deflections according to FIG. 3, either the full half of the conveying path width is not usable or the recording medium (paper discharge channel 31) at the exiting side exhibits a spacing from the entering side (paper admission channel 30) that corresponds to at least 4.4 times the deflection radius of the deflection elements employed. A suitable reverser geometry is described below in order to be nonetheless able to use the full conveying path half for the width of the recording medium, i.e. with optimally small spacing between the paper admission channel 30 and the paper discharge channel 31 and in order to keep the dimensions of the reverser small.

Figure 5:
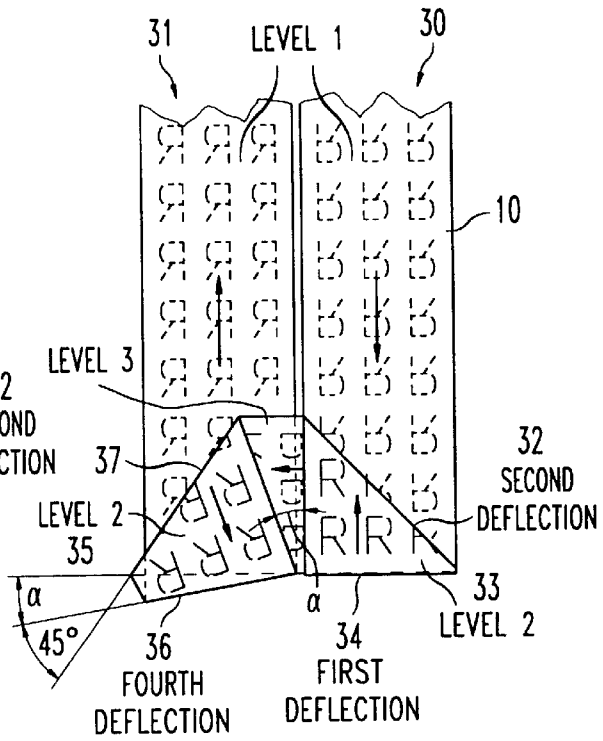
FIGS. 3–6 are schematic illustrations of the geometry of 180° deflections of a recording medium in a turn-over means.
Figure 6:
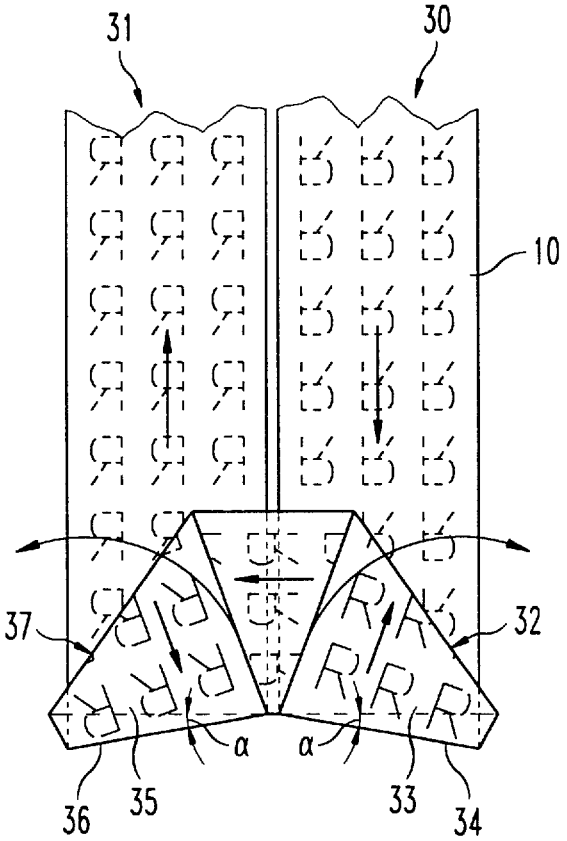

So that the inner band edge do not converge in a punctiform fashion, entering and exiting part of the recording medium are spread. According to the illustrations of FIGS. 4 through 6, two further deflections in the form of straight deflection elements 34, 36 are required therefor, these respectively forming two turning triangles 33, 35 together with the oblique deflection elements. A respective turning triangle with two deflections that are arranged at the angle of 45° relative to one another is thus contained in the paper admission channel 30 and the paper discharge channel 31. The two planes in which the recording medium runs given a reverser geometry corresponding to FIG. 3 become three planes given the examples of FIGS. 4 through 6. The third plane thereby indicates the plane of the transverse path of the recording medium 10 between the two oblique deflection elements. The patterning in FIGS. 3 through 6 is intended to illustrate the respectively occurring side attitude and directional change of the recording medium 10. The turning angle of the two acute-angle deflections 33, 35 (turning triangles) relative to one another (FIG. 5) which is referenced as a spread angle $\alpha$ is theoretically freely selectable from 0° to nearly 90°. 0° corresponds to the arrangement of FIG. 4, thus means an infinitely small deflection radius. The other extreme of nearly 90° is obtained when the third deflection (which is the second oblique deflection element 37 in the second turning triangle 35) is located at an infinitely great distance. An angular range of between about 10° and 20° has proven to be a practical range for the spread angle $\alpha$. As shown in FIG. 6, the two turning triangles in the turn-over means need not be arranged symmetrically to the boundary line between the channels 30, 31. An asymmetrical structure, as shown in FIG. 5, is more space-saving than a mirror-symmetrical structure according to FIG. 6, whereby the first turning triangle 33 is also turned by the spread angle $\alpha$.

Different path levels arise due to the folding of the conveying path between paper admission channel 30 and paper discharge channel 31. It is therefore necessary to conduct the paths past one another via different diameters of the deflection elements. Given an embodiment of the reverser corresponding to FIGS. 4 through 6, the transverse path proceeds inside in the third plane between the first and the second. For this purpose, the deflection radius of the first deflection (cross section, first straight deflection element 34) in the first turning triangle 33 is greater than the deflection radius of the following, second deflection (crossection, first oblique deflection element 32). The sequence is reversed in the second turning triangle 35 of the reverser.

Turn-Over Means with Automatic Threading Means

Figure 4:
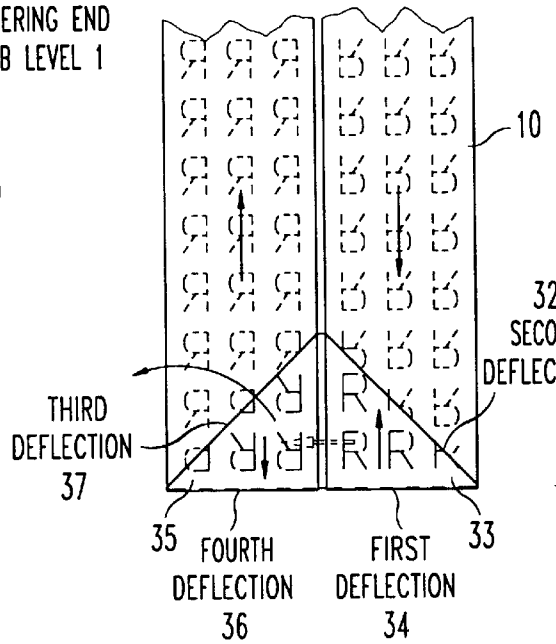

As already fundamentally described with reference to FIGS. 4 through 6, the turn-over means (FIG. 7) contains essentially four deflection elements arranged in two turning triangles 33, 35 via which the recording medium 10 is guided proceeding from the paper admission channel 30 to the paper discharge channel 31. Paper admission channel 30 and paper discharge channel 31 are arranged next to one another in the first plane.

The recording medium 10 supplied via the paper admission channel 30 in the first plane is first deflected into the second plane via the first straight deflection element 34. The straight deflection element 34 is composed of a hollow deflection rod or drum. Following the first straight deflection element 34 in the paper-conveying direction is the first oblique deflection element 32 in the form of a hollow profile arranged at about 45° to the paper running direction for the transverse guidance of the recording medium 10 in the third plane into the region of the second oblique deflection element 37. This likewise comprises a deflection element in the form of a hollow deflection rod arranged at about 45° to the paper running direction. A second straight deflection element 36 that deflects the recording medium 10 into the paper discharge channel 31 follows the second oblique deflection element 37. The diameter of the straight deflection elements is bigger than that of the oblique deflection elements.

Figure 14:
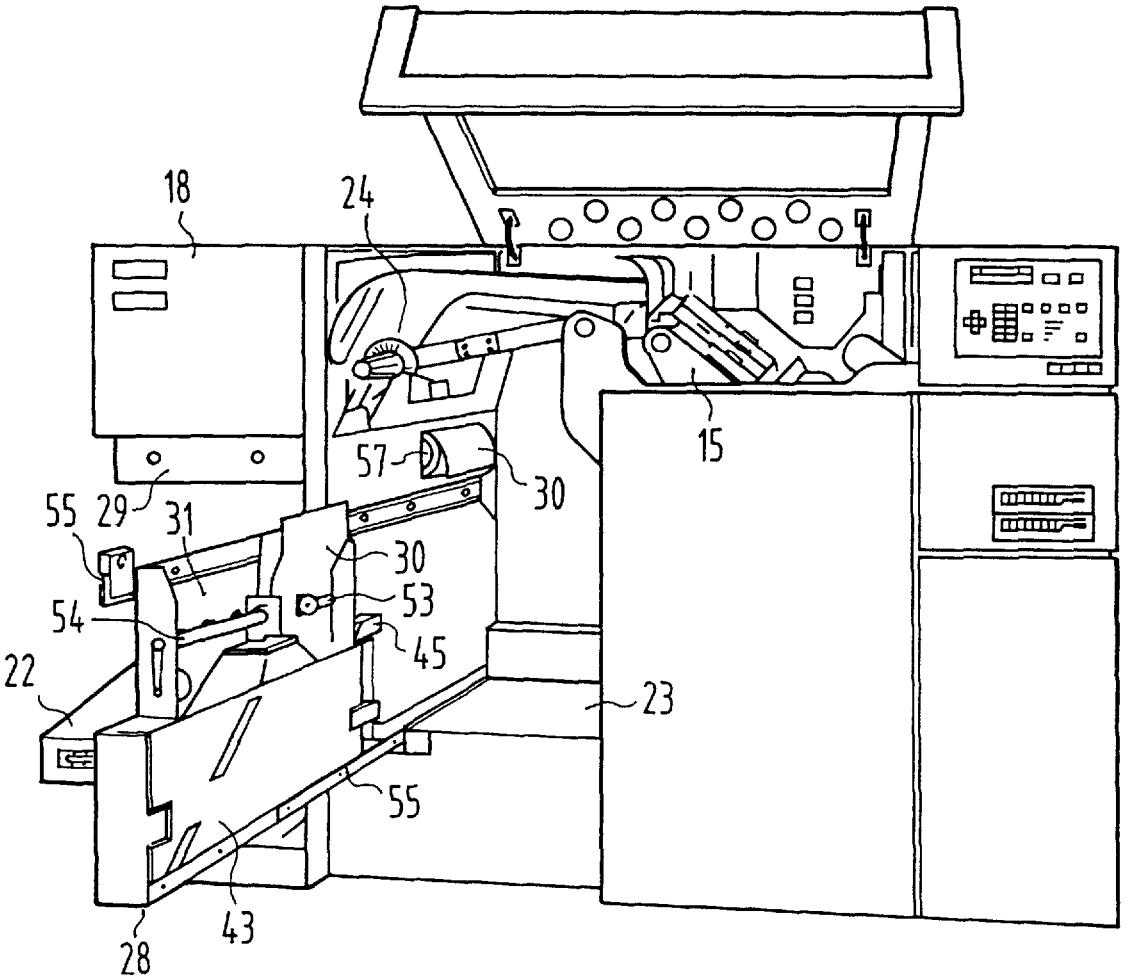
FIG. 14 is a schematic illustration of the turn-over means in a service position.

The deflection elements comprise wear-resistant, polished surfaces as deflection surfaces 38 that serve as glide surfaces for the recording medium 10 and that are embraced by outer guide surfaces 40 at a distance forming a guide channel 39 (FIGS. 8, 9) for the recording medium 10. The complete illustration of the guide channel was foregone in FIG. 7 for reasons of clarity. Inner guide surfaces 41 are arranged in the second and third plane between the deflection elements, so that the guide surfaces 40, 41 form a guide channel 39 proceeding from the paper admission channel 30 around all deflection elements to the paper discharge channel 31. The inner guide surfaces 41 can be part of flaps of hollow profiles that are arranged to be swivelled out. The outer guide surfaces 40, particularly in the region of the deflection elements, can comprise spring steel sheets 42 that are arranged on front-side and back-side housing flaps 43 of the turn-over means that can be swivelled out (FIG. 14).

In order to reduce the friction between glide surfaces and recording medium in the region of the deflection locations, the deflection surfaces 38 comprise air exit openings 44 (FIGS. 7, 11) via which an air pillow can be generated between recording medium and deflection surfaces, particularly during threading. The hollow spaces of the deflection elements are in communication with one another and serve as air supply channels. A connection assembly 45 arranged in the device in the acceptance region for the turn-over means can be coupled to the turning triangle 33 of the right-hand side for controlled delivery of blast air 56 via a blower. It also contains a plug electrical connection.

The turn-over means also contains a threading means for the recording medium 10 with a motor-driven gripper element or conveyor belt 46 guided in the inside region of the turning triangles 33, 35, this gripper element comprising a friction coating 49 for the start of the recording medium, whereby the start of the recording medium is grasped in the region of the first straight deflection element 34 for being threaded into the turn-over means and being conveyed via the first and second oblique deflection element 32, 37 and the second straight deflection element 36 into the region of the paper discharge channel 31.

Figure 7:
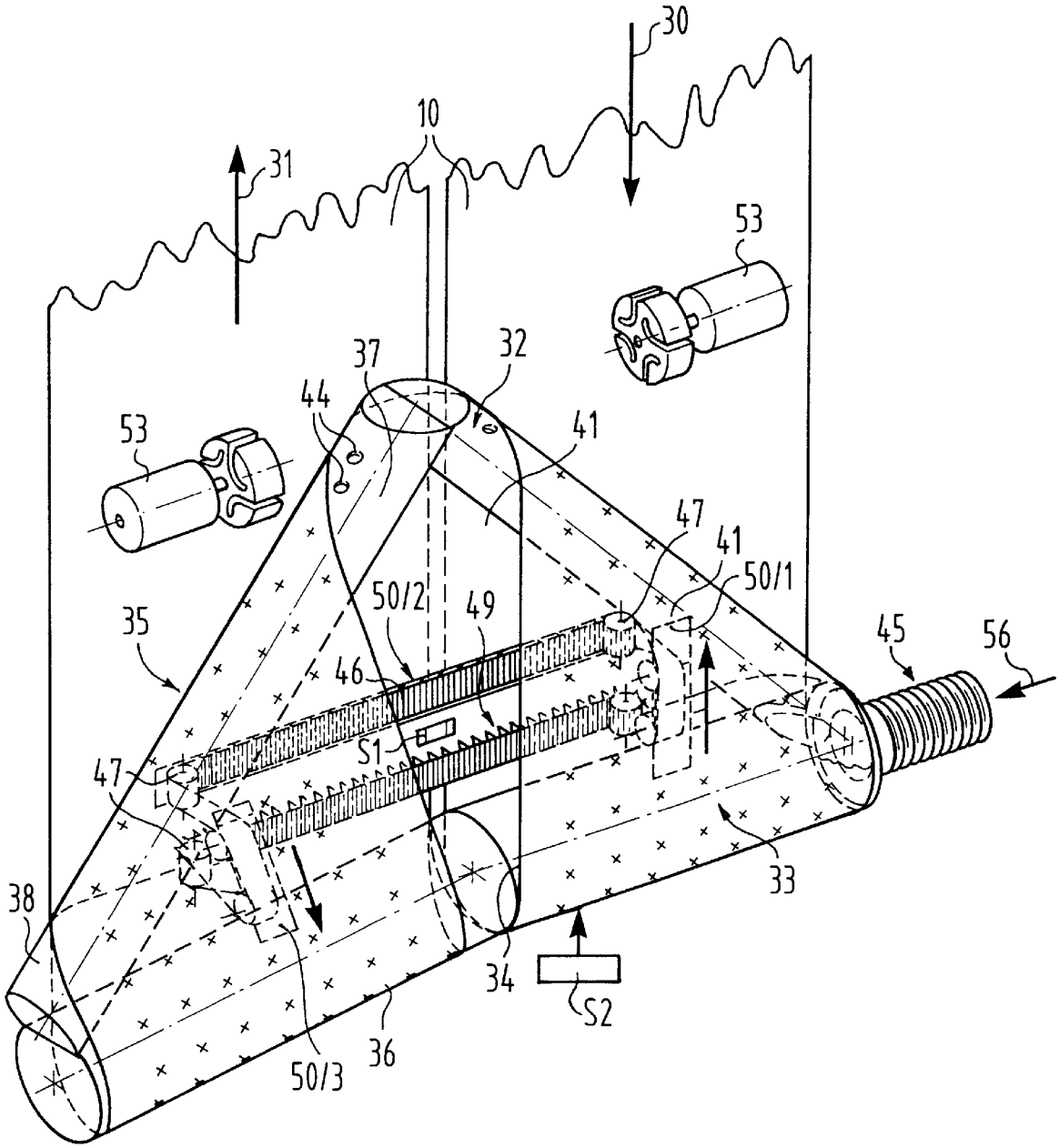
FIG. 7 is a schematic view of a turn-over means with an automatic threading means.
Figure 8:
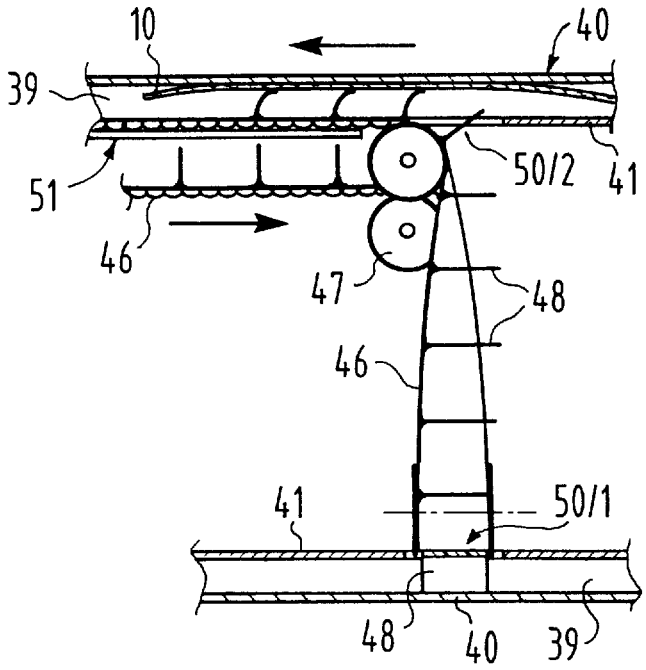
FIG. 8 is a schematic sectional illustration of the conveyor belt guidance in the turn-over means in the region of the first turning triangle, seen from above.
Figure 9:
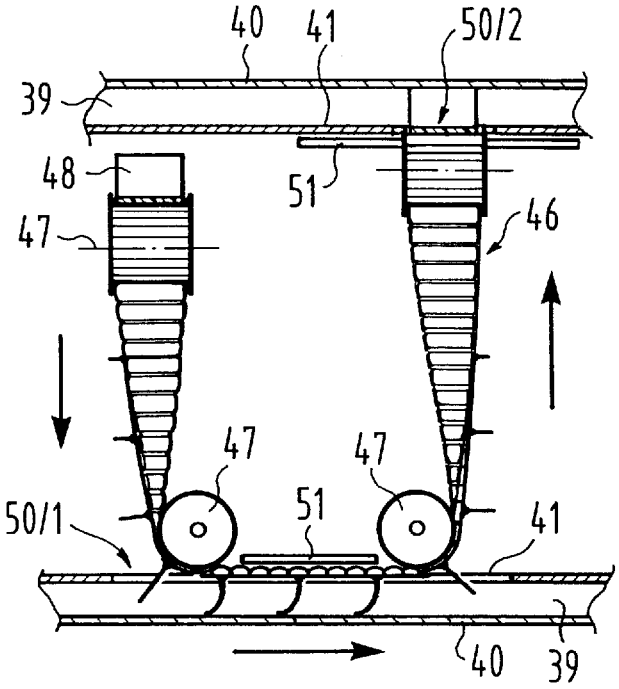
FIG. 9 is a schematic sectional illustration of the conveyor belt guidance in the turn-over means in the region of the first turning triangle in a side view.

The gripper element in the illustrated exemplary embodiment of FIGS. 7 through 9 is composed of a toothed belt as conveyor belt 46 that is conducted over toothed rollers 47. It is driven via a motor (not shown here) coupled to the toothed rollers 47. A friction coating 49 (or friction element) with resilient lamellae 48 of, for example rubber is arranged on one side of the conveyor belt 46. Its length is dimensioned such that, given the operating condition of the turn-over means shown in FIG. 7 wherein the friction element 49 is located between the oblique deflection elements 32, 37, the friction element 49 is disengaged from the recording medium 10. This friction coating is so high that it at least corresponds to the height of the guide channel 39. When the lamellae 48 of the friction coating 49 emerge from the inner guide surface 41, consequently, the recording medium is pressed against the opposite, outer guide surface 40 and, due to the higher coefficient of friction between the friction coating and recording medium than between recording medium and outer guide surface 40, is entrained with the speed of the conveyor belt.

Figure 10:
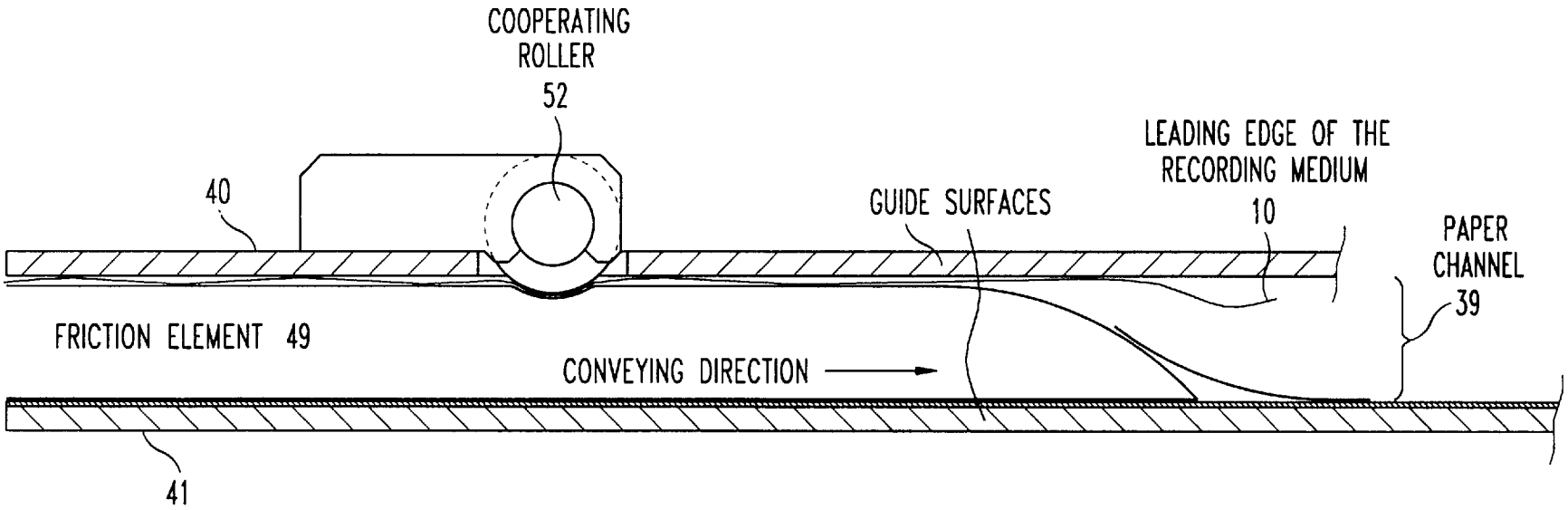
FIG. 10 is a schematic sectional illustration of the guide channel for the recording medium during the automatic insertion phase with counter-rollers arranged therein as pressure elements for the friction element.

So that the lamellae 48 can attack at the recording medium 10, the inner guide surfaces 41 comprise three windows 50/1, 50/2 and 50/3, namely a first window 50/1 after the first straight deflection element 34, a second, longer window 50/2 in the transverse region and a third window 50/3 in front of the second straight deflection element 36. With the lamellae 48 or an elastic friction element, the conveyor belt 46 dips into the window of the guide channel 39 lying between the deflection elements and is guided thereat, whereby guide plates 51 (FIGS. 8, 9) can be provided for the support of the conveyor belt. Particularly in the region of the windows 50/1, 50/2 and 50/3, the outer guide surfaces 40 facing toward the friction element 49 comprise roller elements 52 (FIG. 10) for reducing the friction between recording medium 10 and outer guide surfaces 40. The recording medium 10 is clamped between the roller elements 52 and the friction element 49 and is thus reliably conveyed by the friction element 49.

Figure 2:
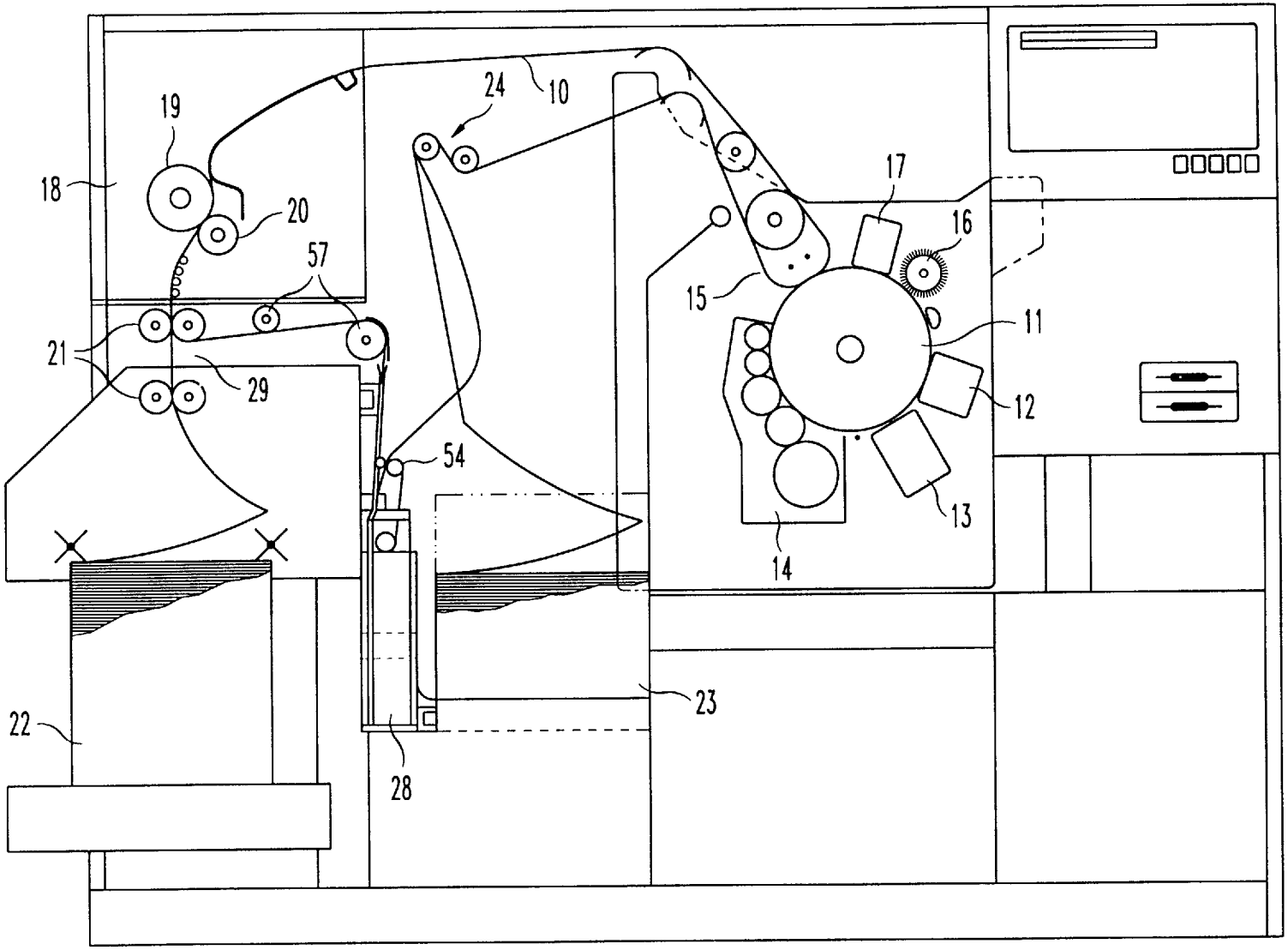
FIG. 2 is a schematic sectional illustration of the same electrographic printer means.

In front of the oblique deflection elements 32, 37, the friction coating or element 49 dips down behind the inner guide surface 41 in order to appear again in a window 50/2, 50/3 after the deflection (FIG. 7). Since the path of the recording medium between two engagement locations at the deflections can be longer than the path of the friction element, it must be assured that the start of the band-shaped recording medium leads be an appropriate amount. This is achieved by correspondingly delayed activation of the conveyor belt. After a complete revolution of the conveyor belt, the friction element must again reside exactly at the initial position. At the end of the threading procedure, it is thus possible to push the start of the recording medium via the friction element 49 far into the paper discharge channel 31, where it is grasped by paper transport elements 53. These paper transport elements 53 can be composed of swivellable friction wheels or beater elements or tractors with transport lamellae. They are arranged in the paper admission channel 30 and in the paper discharge channel 31, namely such that they engage at the side of the recording medium 10 that is free of toner images. An additional conveyor means in the form of motor-driven paper transport rollers 54 is arranged at the end of the paper discharge channel 31 of the turn-over means 28, this serving the purpose of supplying the recording medium 10 to the transfer printing station 15 for the second printing process on the back side (FIGS. 2, 14, 15).

Figure 13:
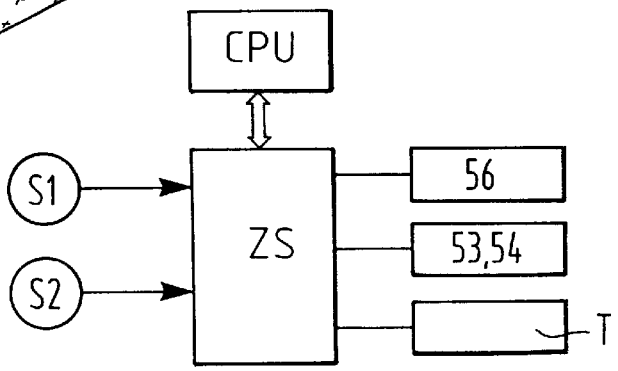
FIG. 13 is a block circuit diagram of a control arrangement for the turn-over means.

The turn-over means is controlled via a microprocessor-controlled threading control arrangement that can be part of the device controller. It is composed of the actual central controller ZS containing a micro-processor. This has its input side in communication with an optical sensor S2 that is arranged under the first straight deflection element 34 and that senses the start of the recording medium in the region of the first oblique deflection element 32 as well as in communication with a sensor S1 arbitrarily arranged in the region of the conveyor belt 46 that can be fashioned as a Hall sensor and that senses the position of the friction element 49 (friction coating) via a magnet element. The threading control arrangement has its output side coupled to the blower for generating the blast air 56, to the drives for the paper transport elements 53 and the paper transport rollers 54 and to the conveyor belt drive T. For threading, the threading control arrangement grasps the start of the recording medium over the sensor S2 in the region of the first straight guide element 34, activates the conveyor belt drive T (FIG. 13) dependent thereon and, dependent on the position signal of the sensor S1 after threading the start of the recording medium through into the paper discharge channel 31, positions the friction element 49 in an idle position in which it is disengaged from the recording medium 10.

The paper admission channel 30 of the turn-over means 28 is in communication, couplable via paper transport elements 57, with a recording medium output channel 29 (FIG. 2) allocated to the fixing station 18 that has a usable width of at least twice the band width of the recording medium 10. The developer station 14 can also comprise two separate developer stations 14/1, 14/2 for, for example, red and black toner in order to be able to print alternatively with different colors.

Figure 15:
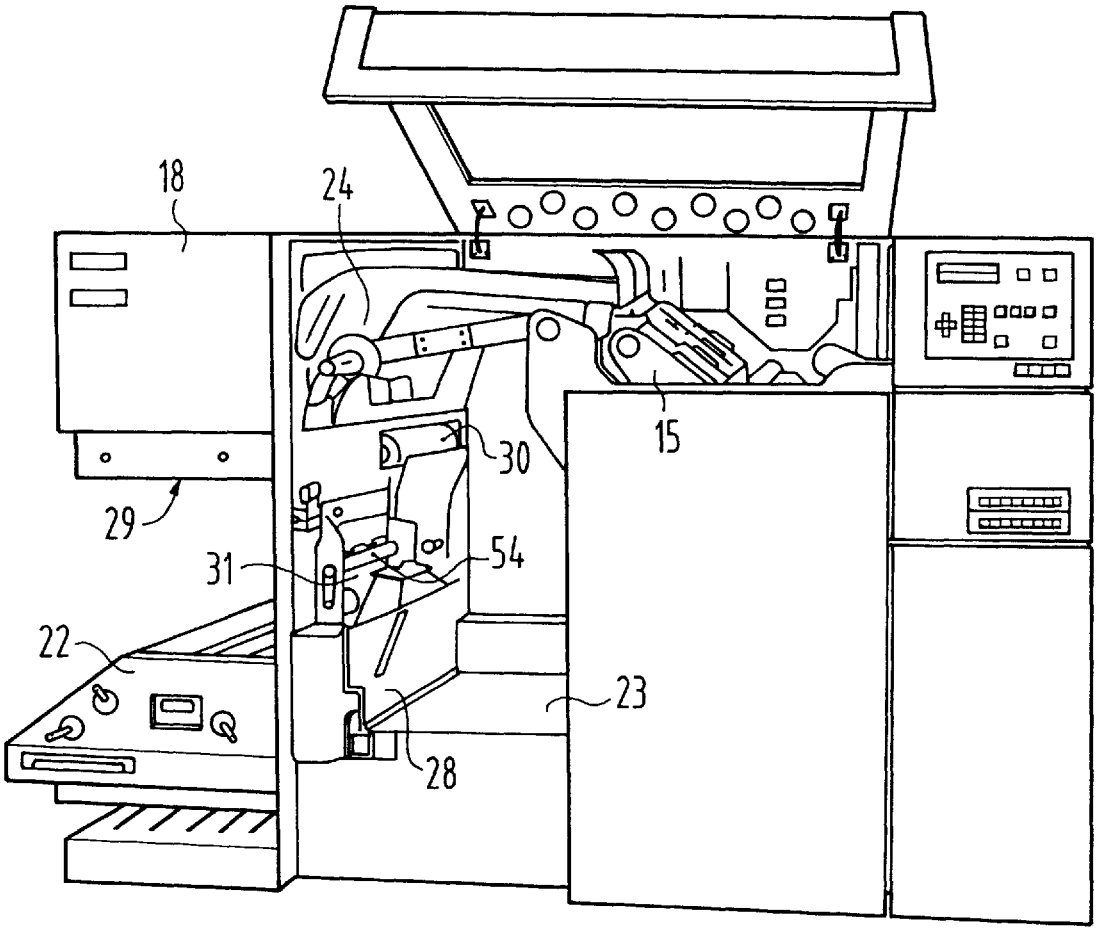
FIG. 15 is a schematic illustration of the turn-over mean in an operating attitude.

The turn-over means is fashioned as an independent, torsionally stiff structural unit and is removably and replaceably seated in the device on telescoping rails 55 (FIGS. 14, 15). All deflection elements are thus freely accessible given malfunctions in paper running and in case of service after flipping the pivotable housing flaps 43 out.

Function of the Turn-Over Means

For automatically threading the recording medium through the turn-over means, the blower for generating blast air 56, the drives for the paper transport elements 53 and the paper transport rollers 54 are activated via the central control ZS for controlling the threading. The friction element 49 is located in the idle position shown in FIG. 7 between the oblique deflection elements 32, 37. The start of the band entering via the paper admission channel 30 is deflected in the guide channel 39 in the region of the first straight deflection element 34 and recognized via the sensor S2. The conveyor belt 46 is started as a result thereof. Via the friction element 49, it seizes the band start (FIGS. 8, 9) through the window 50/1 and conveys it around the first oblique deflection element 32 into the region of the transverse travel, where it is seized again by the friction element 49 via the window 50/2. Subsequently, the start of the recording medium runs around the second oblique deflection element 37. With the back end of the friction element 49, the start of the recording medium is then pushed via the window 50/3 around the second straight deflection element 36 into the paper discharge channel 31 into the region of the paper transport element 53, is seized by the latter and transported up into the region of the paper transport rollers 54 (FIG. 7) and is then transported from there to the transfer printing station. The threading procedure has thus been ended, and the friction element is again in the idle position, disengaged from the recording medium (FIG. 7).

Manual Insertion of the Recording Medium

Figure 11:
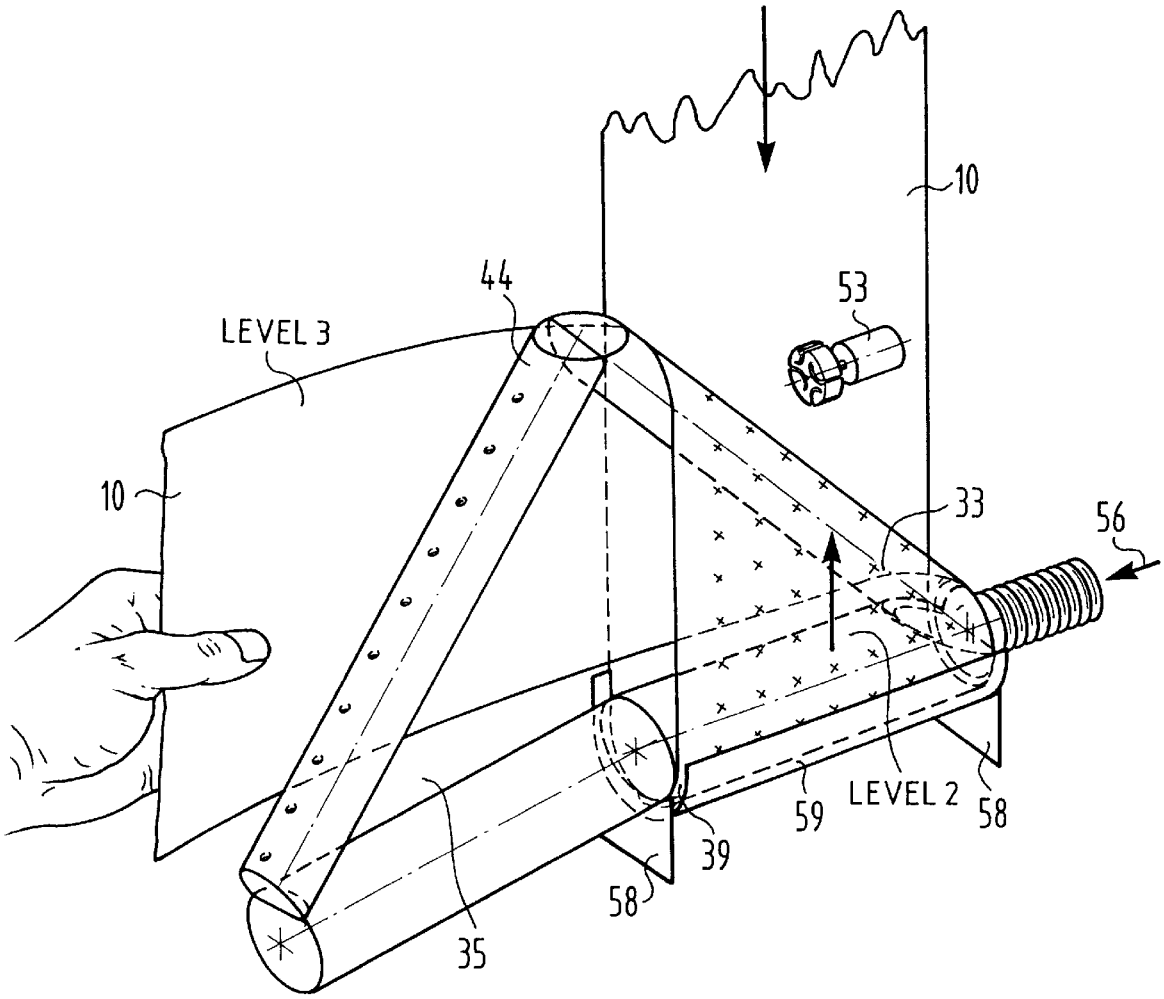
FIGS. 11–12 are schematic illustrations of the manual threading of the recording medium into the turn-over means.
Figure 12:
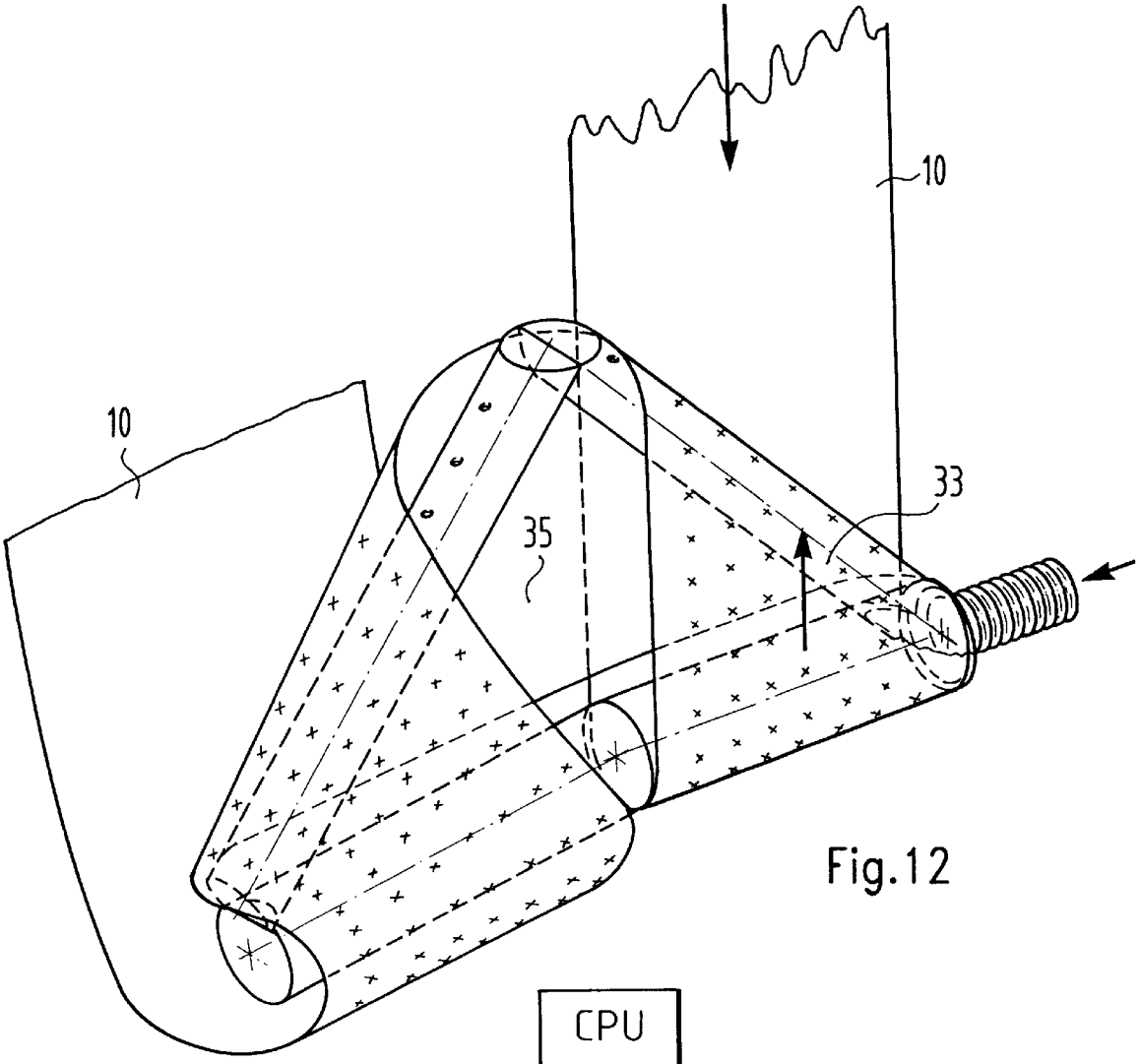

So that the band start of the recording medium can be manually inserted as easily as possible, the turn-over means in an embodiment according to FIGS. 11 and 12 is secured at one side via fastening elements 58 on, for example, telescoping rails 55 in the region of the first turning triangle 33. After the removal of the housing flaps 43, the front second turning triangle is freely accessible. The start of the recording medium 10 is first guided in the first plane via the paper transport element 53 through the deflection channel 39 around the first straight deflection element 34. A deflection plate 59 can thereby be arranged as an additional guide surface. The start of the band is grasped by hand in the second plane, pulled around the first oblique deflection element into the third plane (FIG. 11) and is then guided around the remaining deflections to the paper discharge channel.

A turn-over means as shown in FIGS. 11 and 12 can contain an automatic threading means with internally disposed conveyor belt or, on the other hand, it is designed without treading means only for manual insertion of the recording medium. It can also be alternatively employed as an independent structural unit that is interchangeably secured in the printer device. When, for example, a recording medium is used in the printer having properties (paper weight, tearing strength, etc) that is not suitable for automatic threading with the turn-over means and that can also not be manually threaded through the automatic turn-over means, then it can be removed from the device in a simple way by being pulled out and can be replaced by a manually operated turn-over means.

In the illustrated exemplary embodiment, the gripper element with the gripper means is composed of a conveyor belt 46 with a friction element or coating 49 of lamellae arranged thereon. It is also possible to employ an elastic friction member, for example of silicone, that is moved via traction means. Instead of the start/stop operation of the conveyor belt or, respectively, of the friction element, the conveyor belt can also be continuously moved corresponding to the conveying speed of the recording medium, whereby the friction remains in permanent engagement with the recording medium.

It should also be noted that the function of the paper admission channel can also be assumed by the paper discharge channel and vice versa, i.e. the turn-over means can be operated in two conveying directions.

Although other modifications and changes may be suggested by those skilled in the art, it is the intention of the inventors to embody within the patent warranted hereon all changes and modifications as reasonably and properly come within the scope of their contribution to the art.

We claim:

1. A turnover apparatus for a band-shaped recording medium comprising:

a paper admission channel and a paper discharge channel that are arranged next to one another in close proximity, a first turning triangle allocated to the paper admission channel and a second turning triangle allocated to the paper discharge channel, each respectively comprising a straight deflection element and an oblique deflection element arranged at an angle of about 45° thereto, whereby a) the band-shaped recording medium, proceeding from the paper admission channel, is guided via the deflection elements of the turning triangles up to the paper discharge channel such that the band-shaped recording medium folds completely over around a boundary line between the channels, and b) the turning triangles are arranged in a plane parallel to the paper admission channel and paper discharge channel turned relative to one another by a predetermined spread angle such that the band-shaped recording medium is spread in the region between ends of the oblique deflection elements tapering toward one another, whereby the spread angle exhibits a minimum value with reference to the deflection radius of the deflection elements employed that band edges of entering and exiting portions of the band-shaped recording medium that are directed toward a middle can be guided adjoining one another in close proximity in a region of the boundary line between the channels.

2. A turn-over apparatus according to claim 1, wherein said predetermined spread angle is of 10 through 20 angular degrees.

3. A turnover apparatus according to claim 1, comprising:

a threading means for the band-shaped recording medium that comprises a motor-driven gripper element with gripper means for the band-shaped recording medium, whereby, for threading into the turn-over apparatus, a start of the band-shaped recording medium is grasped in a region of the first turning triangle and is conveyed via the second turning triangle through a guide channel embracing the turning triangles into a region of the paper discharge channel.

4. A turn-over apparatus according to claim 3, comprising:

a gripper element comprising a friction element.

5. A turn-over apparatus according to claim 4, comprising:

a conveyor belt that is arranged in a region within the deflection elements of the turning triangles and accepts the friction element, said conveyor belt being guided such that the friction element dips into the guide channel in sections between the deflection elements and thus enters into friction contact with the band-shaped recording medium.

6. A turn-over apparatus according to claim 5, whereby the friction element can be positioned via the conveyor belt into an idle position in which it is disengaged from the band-shaped recording medium.

7. A turn-over apparatus according to claim 5, wherein said conveyor belt includes elastic carrier lamellae.

8. A turn-over apparatus according to claim 3, further comprising transport rollers for the belt-shaped recording medium arranged in the guide channel.

9. A turn-over apparatus according to claim 3, further comprising:

a first sensor acquiring the position of the gripper element, a second sensor sensing the belt-shaped recording medium in the region of the first turning triangle, and a threading control arrangement coupled to the sensors and recording medium conveyor means that, for threading the start of the belt-shaped recording medium, acquires the start of the belt-shaped recording medium in the region of the first turning triangle via the second sensor, activates the threading means dependent thereon, and, after threading the start of the belt-shaped recording medium through into the paper discharge channel, positions the gripper element in an idle position in which it is disengaged from the belt-shaped recording medium.

10. A turn-over apparatus according to claim 1, whereby the deflection elements comprise air exit openings at least in their deflection region that can be coupled to an air supply system and that serve for generating a friction-reducing air pillow.

11. A turn-over apparatus according to claim 10, whereby the deflection elements are fashioned as hollow members that are in communication with one another for common air supply.

12. A turn-over apparatus according to claim 1, further comprising:

paper transport elements that are arranged in one of the paper admission channel and the paper discharge channel and that deliver the start of the belt-shaped recording medium to the first turning triangle or accept it from the second turning triangle.

13. A turn-over apparatus according to claim 1, further comprising:

fastening means for interchangeably fastening said turn-over apparatus in a printer or copier, said turn-over apparatus being an independent structural unit.

14. A turn-over apparatus according to claim 13, wherein said fastening means is a displacement means.

15. A turn-over apparatus according to claim 1, wherein said turn-over apparatus is arranged in an electrographic printer device for printing band-shaped recording medium, comprising an intermediate carrier with appertaining units for generating toner images on the intermediate carrier;

a transfer printing station that is allocated to the intermediate carrier and accepts the band-shaped recording medium;

a fixing station following the transfer printing station in conveying direction for fixing the toner images on the band-shaped recording medium, whereby intermediate carrier, transfer printing station and fixing station comprise a usable width of at least twice the band width of the band-shaped recording medium, and the turn-over apparatus follows the fixing station and can be coupled to the transfer printing station via the paper discharge channel.

16. A turn-over apparatus according to claim 15, whereby the paper admission channel of the turn-over apparatus is in communication, couplable via paper transport elements, with a recording medium output channel allocated to the fixing station that comprises a usable width of at least twice the band width of the band-shaped recording medium.

* * * * *